US006392564B1

(12) United States Patent
Mackey et al.

(10) Patent No.: US 6,392,564 B1
(45) Date of Patent: May 21, 2002

(54) AGGRESSIVE DRIVER MONITORING AND REPORTING SYSTEM

(76) Inventors: John J. Mackey; Donna M. Mackey, both of 36 Surf Rd., Lindenhurst, NY (US) 11757

( * ) Notice: Subject to any disclaimer, the term of this patent is extended or adjusted under 35 U.S.C. 154(b) by 0 days.

(21) Appl. No.: 09/679,379

(22) Filed: Oct. 5, 2000

Related U.S. Application Data

(60) Provisional application No. 60/157,805, filed on Oct. 5, 1999.

(51) Int. Cl.[7] ..... G08G 1/017

(52) U.S. Cl. ..... 340/937; 340/435; 340/903; 348/148; 348/149

(58) Field of Search ..... 340/937, 903, 340/435, 426; 348/148, 158, 149

(56) References Cited

U.S. PATENT DOCUMENTS 5,027,104 A * 6/1991 Reid ..... 340/426
5,406,324 A * 4/1995 Roth ..... 348/148
5,508,736 A * 4/1996 Cooper ..... 348/144
5,515,042 A * 5/1996 Nelson ..... 340/937
5,680,123 A * 10/1997 Lee ..... 340/937
6,002,326 A * 12/1999 Turner ..... 340/426
6,240,346 B1 * 5/2001 Pignato ..... 340/463

* cited by examiner

*Primary Examiner*—Brent A. Swarthout
(74) *Attorney, Agent, or Firm*—Andrew C. Aitken; Venable Baetjer Howard & Civiletti, LLP

(57) ABSTRACT

This invention relates to a system for motor vehicles to monitor and automatically report to authorities aggressive driving behavior of other vehicles. The camera 10 takes images from the rear view of the vehicle 14 and preferably also from the front. For example, when a vehicle 14 is at a certain MPH and is being followed too closely by another driver (for an extended period of time—ten seconds or more) this event can trigger the system to capture and transmit the rear view images of the offending vehicle. These images are then uplinked to the local law enforcement agency that in turn will determine whether or not a citation or ticket should be automatically mailed to the offender. If the offending driver continues to harass the driver with the system and in doing so drives past the victim, similar images are captured from the frontal view of the vehicle.

1 Claim, 2 Drawing Sheets

AGGRESSIVE DRIVER MONITORING AND REPORTING SYSTEM

This application claims the benefit of provisional application Serial No. 60/157,805, filed Oct. 5, 1999.

BACKGROUND

This invention relates to a system for motor vehicles to monitor and automatically report to authorities aggressive driving behavior of other vehicles.

There is a great need to control aggressive driving. It is not practical for police to observe any but a few instances of aggressive driving. The driver at whom the aggressive driving behavior has been aimed has been in a poor position to report the behavior to authorities, particularly on a basis which could lead to police interceding in the aggressive behavior.

SUMMARY OF THE INVENTION

A camera is mounted in the car that can take pictures both to the rear and to the front of the vehicle in which it is mounted. Either an automatic trigger or a trigger operated by someone in the vehicle starts recording pictures of the aggressively driven vehicle. These pictures are automatically uploaded via a wireless link to various parties including law enforcement.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT

A camera 10 and sensors 12 are mounted on a vehicle 14. Sensor elements measure both distance to an approaching vehicle and the approaching vehicle speed. The camera 10 takes images from the rear view of the vehicle 14 and preferably also from the front. For example, when a vehicle 14 is at a certain MPH and is being followed too closely by another driver (for an extended period of time—ten seconds or more) this event can trigger the system to capture and transmit the rear view images of the offending vehicle. These images are then uplinked to the local law enforcement agency that in turn will determine whether or not a citation or ticket should be automatically mailed to the offender. If the offending driver continues to harass the driver with the system and in doing so drives past the victim, similar images are captured from the frontal view of the vehicle.

The distance required for sensing would be, for example, on the order of a half of a standard car length. The speed required for similar sensing would be on the order of a minimum of 40 MPH.

Figure 1:
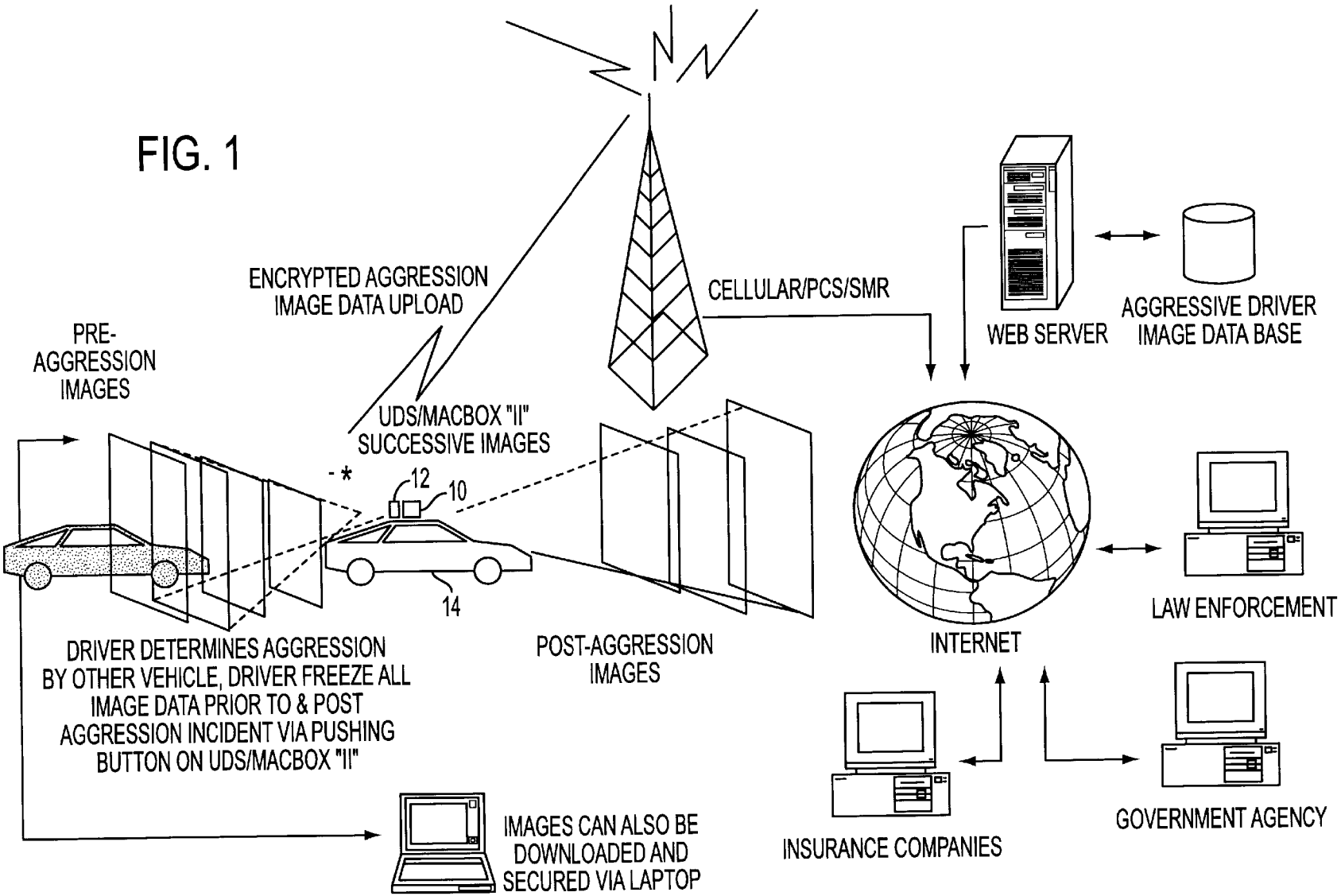
FIG. 1 is a schematic system diagram of the invention.
Figure 2:
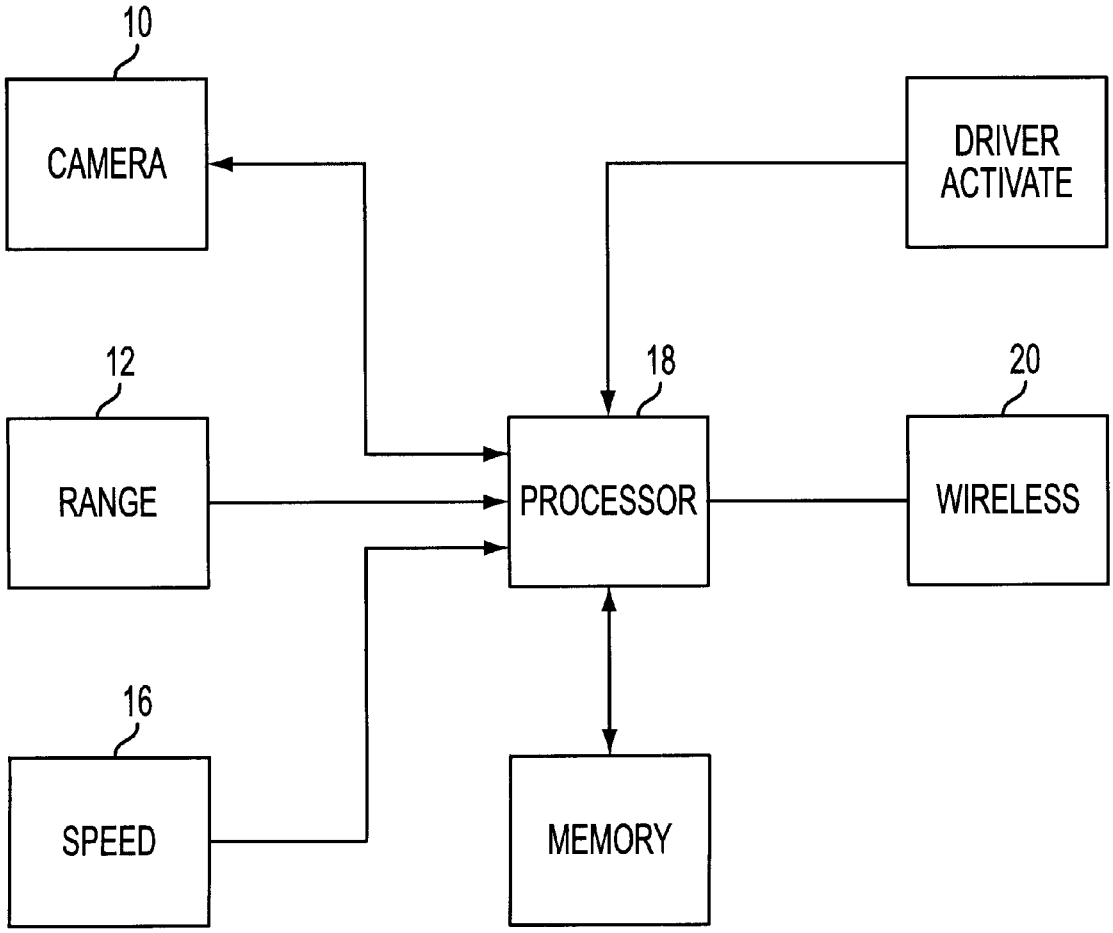
FIG. 2 is a block diagram of the system components on the vehicle.

FIG. 2 is a block diagram of the onboard vehicle components of the system. It includes a camera 10, which may be a digital frame camera or a digital video camera. The sensor 12 may be a short wave radar system of the type developed for vehicle collision avoidance, or optical range finder, such as an auto-focus range finder. A vehicle speed sensor 16 may be derived from the existing vehicle speedometer. A processor 18 processes these inputs. In one embodiment, it triggers the camera 10 to output images to the processor 18 when the combination of speed, distance and time exceed a threshold. The system can be also, or alternatively, activated by a driver or passenger in the vehicle 14. When activated, the processor 18 causes a wireless transmitter 20 to transmit images of the offending vehicle and speed and distance data.

This system would, to a large degree, allow for the monitoring of existing road-rage and aggressive driving habits that are manifested throughout the United States.

While the invention has been described in terms of a single preferred embodiment, those skilled in the art will recognize that the invention can be practiced with modification within the spirit and scope of the appended claims.

We claim:

1. A system to monitor and report aggressive driving, comprising in combination:

a camera mounted on a vehicle for taking images in a region to the rear of said vehicle while said vehicle is in motion;

means for activating said camera in response to aggressive driving when an aggressive driver's distance from said vehicle is about one-half of one standard car length, when said aggressive driver travels at a rate of speed of at least 40 miles per hour, and maintains said distance for at least ten seconds;

means to automatically transmit said images by a wireless link to a remote station, said remote station selected from the group consisting of: a local law enforcement agency, government agency, and an insurance company.

* * * * *